US006535089B1

(12) United States Patent
Iio

(10) Patent No.: US 6,535,089 B1
(45) Date of Patent: Mar. 18, 2003

(54) HIGH-FREQUENCY CIRCUIT DEVICE AND COMMUNICATION APPARATUS USING THE SAME

(75) Inventor: Kenichi Iio, Nagaokakyo (JP)

(73) Assignee: Murata Manufacturing Co. Ltd.

( * ) Notice: Subject to any disclaimer, the term of this patent is extended or adjusted under 35 U.S.C. 154(b) by 0 days.

(21) Appl. No.: 09/587,354

(22) Filed: Jun. 5, 2000

(30) Foreign Application Priority Data

Jun. 3, 1999 (JP) ..... 11-156344

(51) Int. Cl.[7] ..... H01P 3/00; H01P 3/08
(52) U.S. Cl. ..... 333/238; 333/219; 333/246
(58) Field of Search ..... 333/238, 246

(56) References Cited

U.S. PATENT DOCUMENTS 3,093,805 A * 6/1963 Osifchin et al. ..... 174/117 R
3,975,690 A * 8/1976 Fleming ..... 330/5
4,675,620 A * 6/1987 Fullerton ..... 333/1
4,906,953 A * 3/1990 Li et al. ..... 333/33
5,157,361 A * 10/1992 Gruchalla et al. ..... 333/20
5,426,399 A * 6/1995 Matsubayashi et al. ..... 333/1
5,777,528 A * 7/1998 Schumacher et al. ..... 333/33

FOREIGN PATENT DOCUMENTS

EP 0975043 A2 1/2000
GB 2322237 A 8/1998

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

A high-frequency circuit device solves problems caused by a spurious mode reflection generated at a part where propagation of a spurious mode wave is prevented, with the result that propagation of the spurious mode wave such as a parallel plate mode wave is blocked. In the arrangement of the high-frequency circuit device, a leakage spurious mode wave radiates from a transmission line including at least two parallel planar conductors, and the leakage spurious mode wave is reflected by a spurious-mode reflection circuit disposed parallel to the transmission line. The distance between the transmission line and the spurious-mode reflection circuit is equivalent to the length in which a wave reflected by the spurious-mode reflection circuit is cancelled by the transmission line.

14 Claims, 13 Drawing Sheets

HIGH-FREQUENCY CIRCUIT DEVICE AND COMMUNICATION APPARATUS USING THE SAME

BACKGROUND OF THE INVENTION

1. Field of the Invention

The present invention relates to a high-frequency circuit device such as a waveguide or a resonator having two parallel planar conductors, and the invention also relates to communication apparatus using the same.

2. Description of the Related Art

As transmission lines used in microwave bands and millimeter-wave bands, for example, there are known grounded coplanar lines, each of which has a ground electrode formed on the substantially the entire surface of a dielectric plate and a coplanar line formed on the other surface thereof, grounded slot lines, each of which has a ground electrode formed on a surface of a dielectric plate and a slot line formed on the other surface thereof, and planar dielectric lines having slots formed on both surfaces of a dielectric plate, the slots opposing each other through the thickness of the dielectric plate.

Since each of the above transmission lines has a structure including two parallel planar conductors, for example, when electromagnetic fields are disturbed at the inputs/outputs and bends of the transmission lines, a spurious mode wave such as the so-called parallel-plate mode, which is a parallel plane mode, is induced between the two parallel planar conductors, and the spurious mode wave thereby propagates between the planar conductors. As a result, between adjacent transmission lines, interference is caused by a leakage wave of the above spurious mode, thereby often leading to leakage of signals.

FIG. 19 illustrates an example of electromagnetic-field distributions of the main propagating mode of a grounded coplanar line and a parallel-plate mode associated with the main propagating mode. In FIG. 19, reference numeral 20 denotes a dielectric plate. On substantially the entire lower surface of the dielectric plate 20 is formed an electrode 21, and on the upper surface thereof are formed a strip conductor 19 and electrodes 22. In this case, the electrodes 21 and 22 are used as ground electrodes, and the grounded coplanar line is comprised of these electrodes 21 and 22, the dielectric plate 20, and the strip conductor 19. In such a grounded coplanar line, disturbances of the electromagnetic fields occur at edges of the line to induce electric fields vertically running through the electrodes 21 and 22 formed on the upper and lower surfaces of the dielectric plate 20. As a result, a parallel-plate mode electromagnetic field is generated as shown in FIG. 19. In this figure, the arrows indicated by solid lines shows electric field distributions, broken-line arrows show magnetic field distributions, and dash-double-dot-line arrows show current distributions.

In order to prevent such spurious mode wave propagation, conventionally, an electric wall is formed along each side of the transmission line, for example, by a plurality of through-holes which electrically connect the electrodes formed on the upper and lower surfaces of the dielectric plate. The through-holes are spaced apart by distances much shorter than the wavelength of the propagating mode.

When the electric walls mentioned above, are formed along the direction in which an electromagnetic wave of the transmission line propagates, the electric walls serve to block the propagation of a spurious mode wave such as a parallel plate mode wave. However, a problem with this arrangement is that the spurious mode wave is reflected by the electric walls back to the transmission line. Eventually, the spurious mode wave is likely to be converted into the mode of the transmission line.

SUMMARY OF THE INVENTION

Accordingly, it is an object of the present invention to provide a high-frequency circuit device and a communication apparatus using the same that can solve the above-described problems caused by the reflection of a spurious mode wave occurring at a location where the propagation of the spurious mode wave is blocked so as to block the propagation of a spurious mode such as a parallel plate mode.

For example, in the case of a grounded coplanar line, with disturbances of electromagnetic-fields generated by a strip conductor forming the grounded coplanar line and electrodes disposed at the sides thereof, the electromagnetic wave of a spurious mode such as a parallel plate mode propagates between two parallel conductors, and when the electromagnetic wave reaches the boundary of a conductor pattern, a part of the electromagnetic wave is reflected at the boundary of the conductor pattern. The present invention uses this reaction to suppress the spurious mode such as the parallel plate mode.

In other words, according to an aspect of the present invention, there is provided a high-frequency circuit device including at least two parallel planar conductors, an electromagnetic-wave excitation circuit exciting an electromagnetic wave between the two planar conductors, and a spurious-mode reflection circuit reflecting a spurious mode wave propagating between the two planar conductors. In this high-frequency circuit device, the spurious-mode reflection circuit is disposed apart from the electromagnetic-wave excitation circuit by a distance at which the electromagnetic-wave excitation circuit cancels the wave reflected by the spurious-mode reflection circuit. With this arrangement, the spurious mode wave propagating between the two parallel planar conductors is reflected by the spurious-mode reflection circuit, and then, the reflected wave is cancelled after returning to the electromagnetic-wave excitation circuit. The spurious-mode reflection circuit is formed by using the conductor pattern of each of the parallel planar conductors.

In addition, for example, the distance between the spurious-mode reflection circuit and the electromagnetic-wave excitation circuit, which is represented by the symbol w, may be obtained by the following equation:

$$w=\{m\pi-\arg(\Gamma)\}/[2k\sqrt{\{1-(\beta/k)^2\}}]$$

In this equation, the symbol m represents an odd number of 1 or greater, the symbol arg(Γ) represents a reflection phase in the reflection circuit, the symbol k represents a vector k with respect to a direction in which the spurious mode wave propagates, and the symbol β represents a phase constant of the main propagating mode of the electromagnetic-wave excitation circuit.

In addition, the spurious-mode reflection circuit may be comprised of a plurality of micro-strip lines disposed at distances from each other, the distances being shorter than the length of an electromagnetic wave.

In addition, the spurious-mode reflection circuit may be either a magnetic wall or an electric wall generated on a dielectric plate having the two planar conductors formed thereon.

In addition, the electromagnetic-wave excitation circuit may be a transmission line. For example, this arrangement can prevent interference of the spurious mode wave between adjacent transmission lines and interference of the spurious mode wave between the transmission line and a resonator.

In addition, the electromagnetic-wave excitation circuit may be a resonator. This arrangement can prevent, for example, interference of the spurious mode wave between adjacent resonators and interference of the spurious mode wave between the resonator and the transmission line.

Furthermore, according to another aspect of the present invention, there is provided a communication apparatus including the above-described high-frequency circuit device, which is used in a communication-signal propagating unit, wherein a signal processing unit such as a filter passes and/or blocks the communication signal in a specified frequency band.

Other features and advantages of the present invention will become apparent from the following description of embodiments of the invention which refers to the accompanying drawings.

DETAILED DESCRIPTION OF EMBODIMENTS OF THE INVENTION

Figure 1:
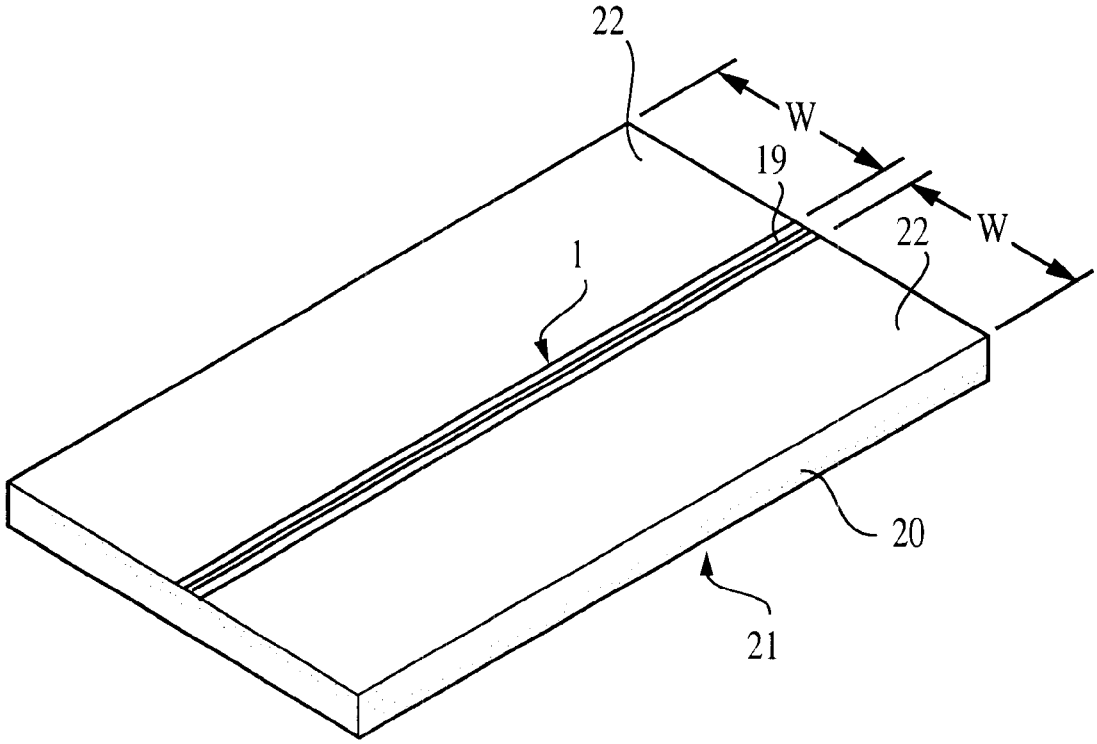
FIG. 1 is a perspective view illustrating the structure of a high-frequency circuit device according to a first embodiment of the present invention.

FIG. 1 shows a first embodiment of the invention, in which a grounded coplanar line is used as a transmission line. In this figure, reference numeral 20 denotes a dielectric plate. On the upper surface thereof, a strip conductor 19 is disposed. At each side of the upper surface of the dielectric plate 20, an electrode 22 is disposed in such a manner that the electrodes 22 are spaced apart from the strip conductor 19 at specified distances. In addition, on the entire lower surface of the dielectric plate 20, a ground electrode 21 is disposed. With this arrangement, a part indicated by reference numeral 1 acts as a grounded coplanar line.

Next, referring to FIG. 2, a system of suppressing a parallel plate mode will be illustrated below.

Figure 2:
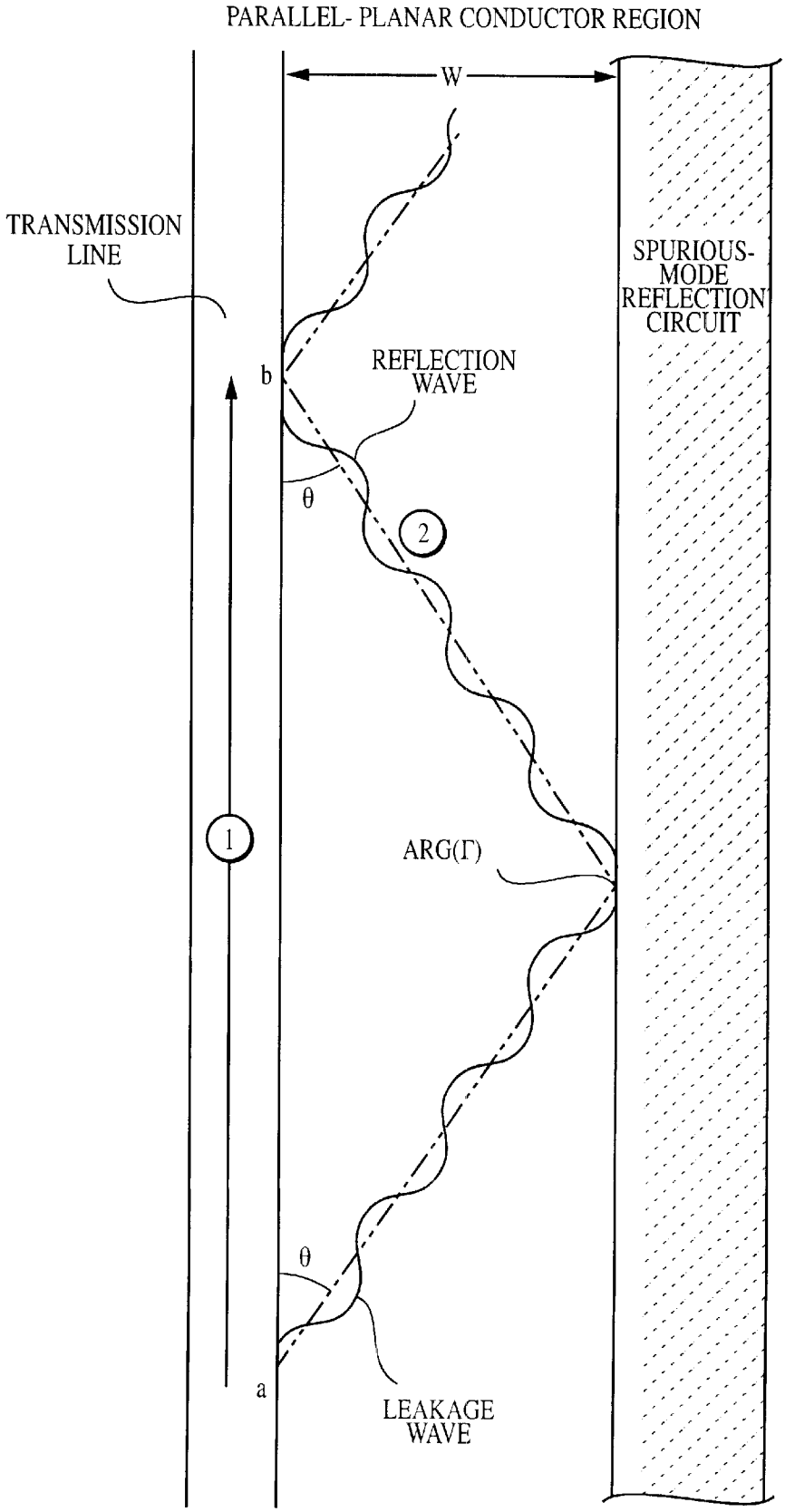
FIG. 2 is a view illustrating a principle of spurious mode suppression.

In FIG. 2, a parallel plate mode wave generated at point A on a transmission line propagates in a manner radiating away from the transmission line. However, since a spurious-mode reflection circuit is disposed parallel to the transmission line, the parallel-plate mode wave is totally reflected by the spurious-mode reflection circuit, and the wave propagates between parallel planar conductors to return to the transmission line. The point at which the reflected parallel plate mode wave reaches the transmission line is point B. At point B, subsequent parallel-plate mode wave is excited and radiated. As a result, the subsequently generated parallel-plate mode wave and the reflected parallel-plate mode wave end up interfering with each other. When the mutual interference between the two waves acts so as to strengthen electric fields, conversion into a parallel plate mode is facilitated, whereas when the interference acts so as to weaken the electric fields, the parallel plate mode is suppressed.

Conditions causing the interference between the parallel-plate mode wave generated from the transmission line (hereinafter referred to as a leakage wave) and the parallel-plate mode wave reflected from the spurious mode reflection circuit (hereinafter referred to as a reflected wave) are determined by propagation characteristics of the transmission line and the parallel-plate mode wave, and the determined conditions change with a width w of the structure forming each of the parallel planar conductors.

Next, the conditions by which the above parallel-plate mode wave is suppressed will be illustrated below.

In general, an electromagnetic wave excited by a line wave source has a certain fixed directivity, The fact that the wave has the fixed directivity can be shown by using an antenna analysis method. For example, in the case of the grounded coplanar line shown in FIG. 1, the directivity can be obtained by the following equation.

$$\theta=\cos^{-1}(k/\beta) \quad (1)$$

In this equation, the symbol k represents a vector k corresponding to a direction in which is generated leakage wave propagates, and the symbol β represents a phase constant of a main propagating mode wave propagating through the transmission line.

The wave propagating through the coplanar line is separated into a main propagating mode wave and a generated spurious-mode leakage wave accompanying the main propagating mode wave. The leakage wave propagates in a direction θ with respect to the direction in which the main mode wave propagates. However, the spurious-mode reflection circuit disposed parallel to the transmission line allows the spurious mode wave to be totally reflected so as to be directed back toward the transmission line. In FIG. 2, considering the path of the main propagating mode wave 1 and the path of the reflected spurious mode wave 2, with the amounts of phase changes in directions in which these waves propagate being φ1 and φ2, the following equations are obtained:

$$\phi 1=\beta(2w)/\tan\theta$$

$$\phi 2=2k_0w/\sin\theta+\arg(\Gamma) \quad (2)$$

In this case, the symbol $k_0$ represents the phase constant of the leakage wave, and the symbol arg(Γ) represents the reflection phase of the spurious-mode reflection circuit.

Therefore, the phase difference between the two waves is expressed by the following equation:

$$\Delta\phi=\phi 2-\phi 1=2k_0w/\sin\theta+\arg(\Gamma)-\beta(2w)/\tan\theta=(2k_0w/\sin\theta)(1-\beta\cos\theta/k_0)+\arg(\Gamma)$$

In this case, based on conditions in which cos θ is equal to $\beta/k_0$ and sin θ is equal to $\sqrt{\{1-(\beta/k_0)^2\}}$, the following equation is obtained:

$$\Delta\phi=2k_0w\sqrt{\{1-(\beta/k_0)^2\}}+\arg(\Gamma) \quad (3)$$

When the interference waves of the two waves, which are hereinafter referred to as the two interference waves, have the same phases, the electric fields strengthen each other, whereas when the two interference waves have opposite phases, the electric fields weaken each other. Since the amount of conversion from the main propagating mode into a spurious mode is proportional to the square of the electric-field strength, when the two interference waves have the same phase, the ratio of occurrence of a spurious mode wave is maximized, whereas when the two interference waves have opposite phases, the ratio of the occurrence of the spurious mode wave is minimized.

Therefore, when Δφ is equal to mar and $k_0$ is equal to k, the following equations are obtained as conditions for suppressing the spurious mode wave with respect to the position of the spurious-mode reflection circuit.

$$m\pi-\arg(\Gamma)=2k_0w\sqrt{\{1-(\beta/k_0)^2\}}$$

$$w=\{m\pi-\arg(\Gamma)\}/[2k\sqrt{\{1-(\beta/k_0)^2\}}] \quad (4)$$

In these equations, the symbol m is equivalent to an odd number of 1 or greater.

Consequently, in the high-frequency circuit device shown in FIG. 1, the end faces of the dielectric plate 20, which are parallel to the coplanar line 1, become electrodeless magnetic walls serving as total-reflection walls against the spurious mode wave. Thus, when the distance w from the coplanar line 1 to the dielectric plate 20 is set as the length expressed by the equation (4), a specified spurious mode such as a parallel plate mode can be most efficiently suppressed.

Next, in terms of the high-frequency circuit device having the structure shown in FIG. 1, an analysis will be made by using a finite element method to indicate the adequacy of the aforementioned designing method.

As a test model, the high-frequency circuit device shown in FIG. 1 is used. The relative permittivity of the dielectric plate used in the high-frequency circuit device is set as 3.2 and the thickness thereof is set as 0.3 mm. The strip conductor 19 formed on the dielectric plate 20, the electrode 22 formed at each side thereof, and the ground electrode 21 formed on the lower surface thereof are assumed to be perfect conductors. In addition, in order to generate a spurious-mode wave coupling, the distance between the strip conductor 19 and the electrode 22 is set to be extremely short, namely 0.1 mm. Furthermore, the frequency used is set to be 30 GHz, and a wall satisfying the conditions of the total reflection is a magnetic wall. In terms of the above structural parameters, when the input/output terminals of a micro-strip line are set such that they have resistance of 50Ω, the phase constant of a quasi-TEM mode is 1060 (rad/m), whereas the vector k of the spurious mode is 996 (m/s). In this case, since the electric field of the main propagating mode is generated between the strip conductor 19 and the electrode 21 formed on the lower surface of the dielectric plate, a micro-strip line is provided instead of a coplanar line.

Based on the above set values, as the result of the value analysis by using the finite element method with a three-dimensional electromagnetic-field simulator as a high-frequency structure simulator (HFSS), it was found that the maximum angular direction of the directivity is a direction of approximately 20° with respect to a direction in which the parallel plate mode propagates.

Figure 3A:
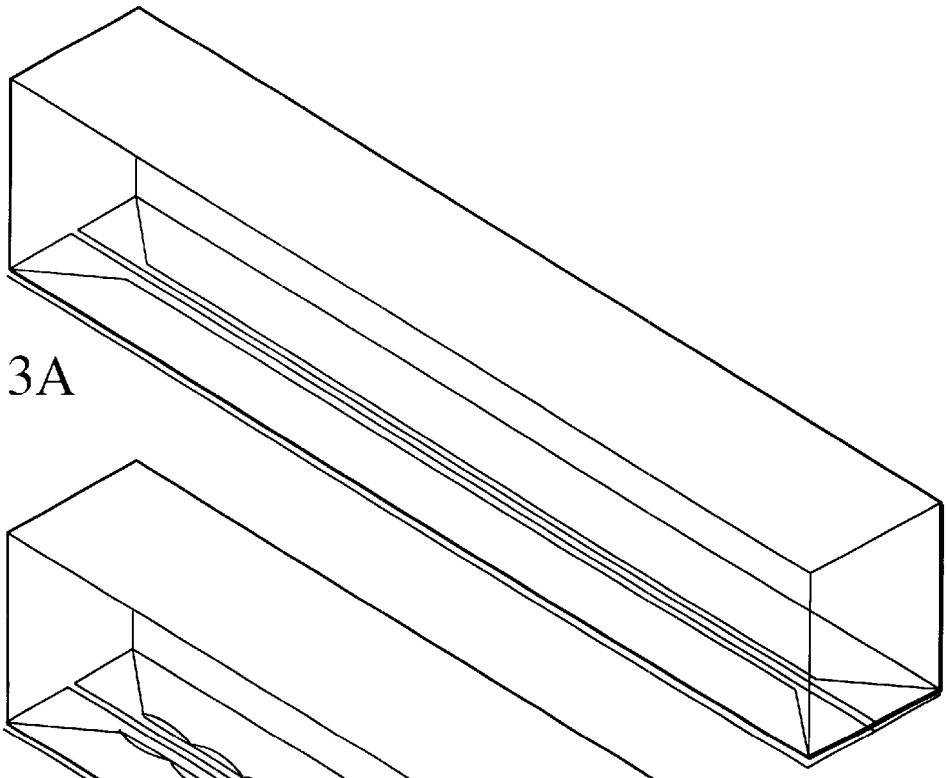
FIG. 3A shows a perspective view illustrating the structure of a grounded coplanar line and the upper shielded space.
Figure 3B:
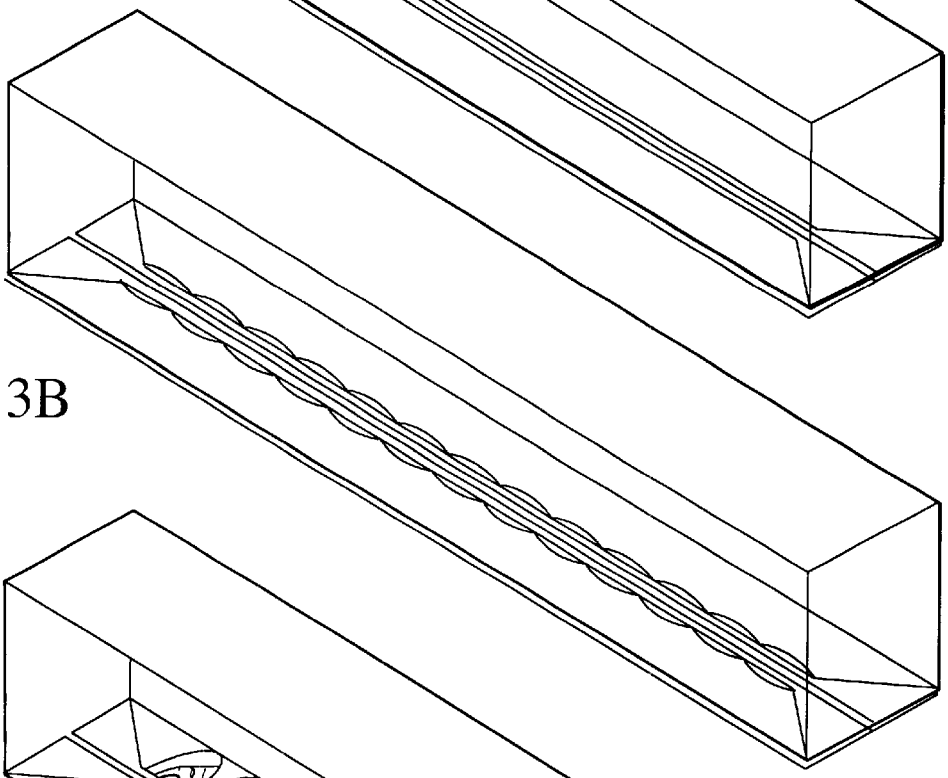
FIGS. 3B and 3C show the distributions of electromagnetic-field strengths in cases in which the interference phases of a main propagating mode wave and a leakage wave are opposite to each other and both the waves are the same.
Figure 3C:
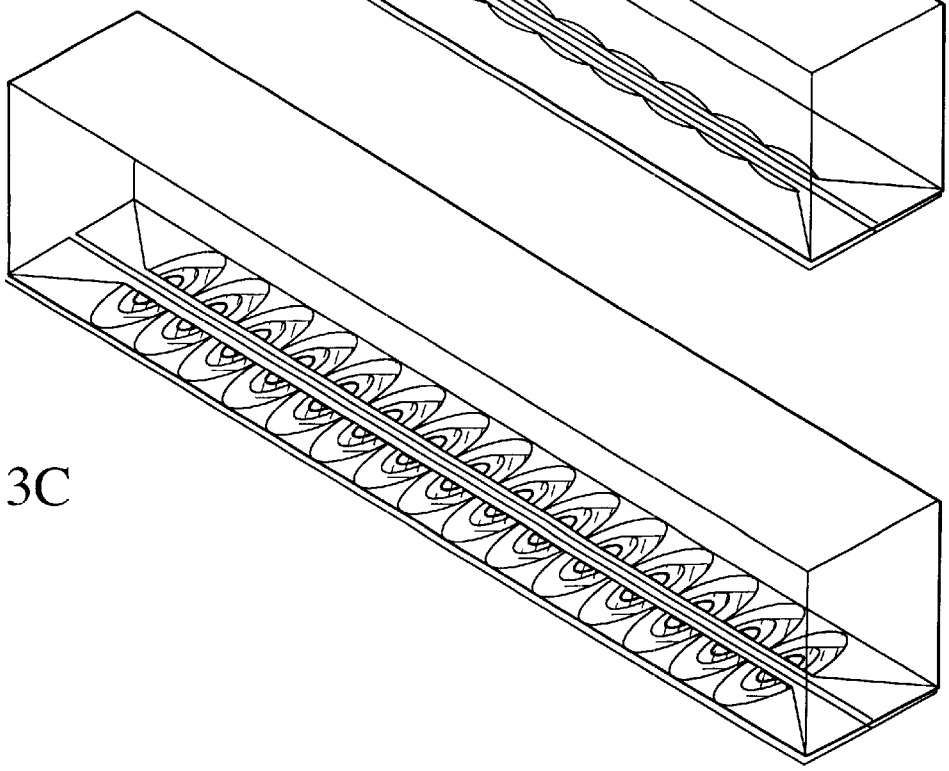

FIG. 3A shows a perspective view of the structure formed by a grounded coplanar line and the shield space on the upper part of the line. FIGS. 3B and 3C show the distributions of electromagnetic-field strengths obtained by the HFSS when the phases of the two interference waves are changed. FIGS. 3B and 3C show contour views illustrating the electromagnetic-field strengths of parallel plate modes. Specifically, FIG. 3B illustrates a case in which the interference phases of the main propagating mode and a reflection wave are opposite, and FIG. 3C illustrates a case in which the interference phases of the main propagating mode and the reflection wave are the same. As shown here, when the interference phases thereof are the same, a spurious mode wave is generated from the entire transmission line, whereas when the interference phases thereof are opposite, occurrence of the spurious mode wave is suppressed.

Figure 4:
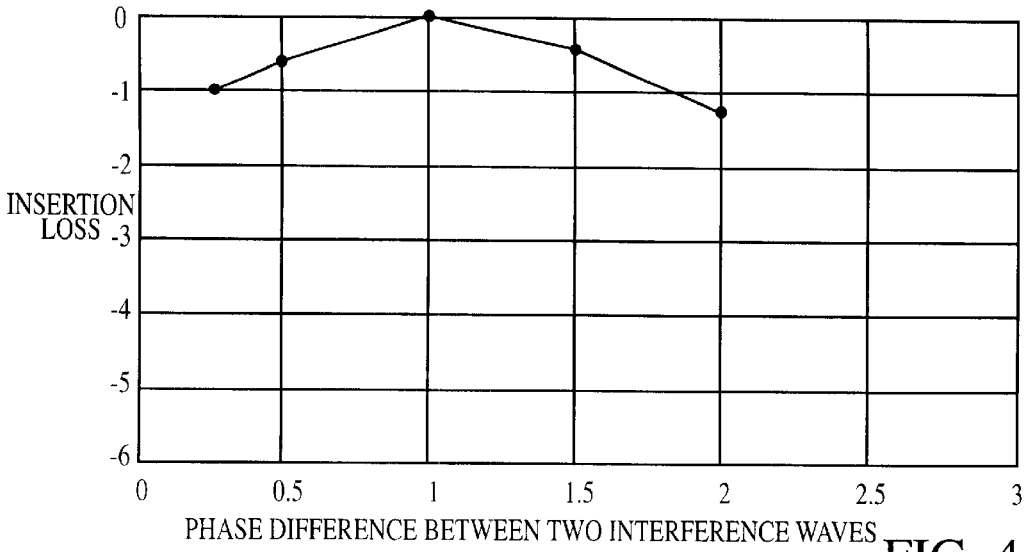
FIG. 4 is a graph showing the relationship between the phase difference between the above two interference phases and insertion loss.

FIG. 4 shows a quantitative result regarding the above phenomena. This figure shows the relationship between the phase difference between the two interference waves and transmission losses, which are insertion losses, with a limited frequency of 30 GHz. In addition, since it is assumed that the dielectric member and the electrodes generate no loss, the loss shown in this case can be regarded as the amount of loss in the conversion from the main propagating mode into the spurious mode wave.

In FIG. 4, a lateral axis indicates the phase difference between the two interference waves, and a vertical axis indicates the insertion loss. Since a magnetic wall is assumed to be a wall satisfying the conditions of total reflection and the reflection phase is set to be zero, when the distance w between a source from which a spurious mode wave is generated and the wall is zero, the two interference waves most strengthen each other. Then, as the distance w is increased, the two interference waves increasingly weaken each other until the phase difference between the two interference waves becomes $\pi$. Then, as the distance w is further increased, the two interference waves begin again to strengthen each other, with the result that the amount of conversion into the spurious mode wave increases. Therefore, when the distance between the spurious-mode-wave generating source and the wall is set to be equivalent to a distance necessary to make the phase difference between the two interference waves $\pi$, the spurious mode can be most efficiently suppressed.

As a result, the validity of the aforementioned designing method can be proved.

Next, the structure of a high-frequency circuit device according to a second embodiment of the present invention will be illustrated with reference to FIG. 5.

Figure 5:
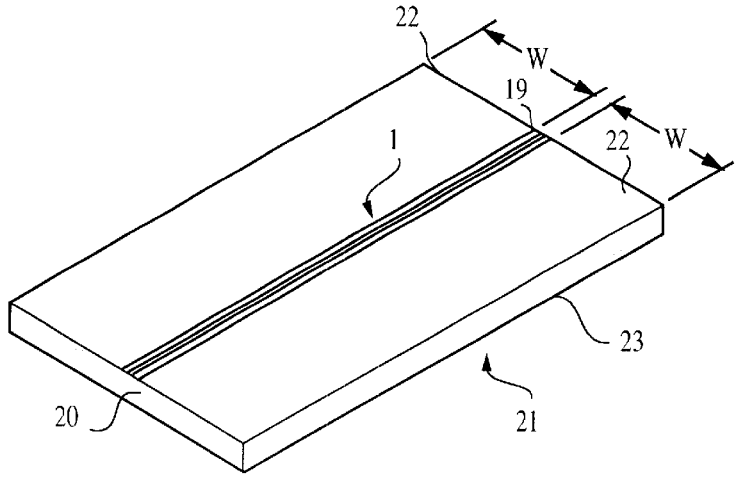
FIG. 5 is a perspective view illustrating the structure of a high-frequency circuit device according to a second embodiment of the present invention.

In FIG. 5, reference numeral 20 denotes a dielectric plate, a strip conductor 19 is formed on the upper surface thereof, and an electrode 22 is formed at each side of the dielectric plate 20 at a specified distance from the strip conductor 19. In addition, on the entire back surface of the dielectric plate 20, a ground electrode 21 is formed. With this arrangement, a part indicated by reference numeral 1 acts as a grounded coplanar line. An electrode 23 is disposed on an end face parallel to the grounded coplanar line 1 of the dielectric plate 20 so that the end face is used as an electric wall. As a result, the reflection phase arg($\Gamma$) shown in the equation (2) is equal to $\pi$, which is 180 degrees, and under this condition, the distance w from the coplanar line 1 to the edge of the dielectric plate 20 parallel thereto is obtained by the equation (4).

Figure 6:
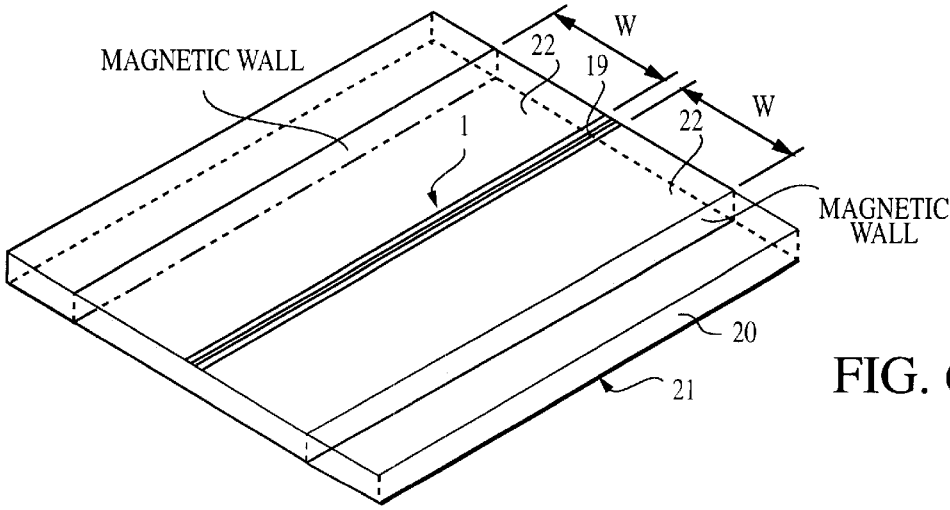
FIG. 6 is a perspective view illustrating the structure of a high-frequency circuit device according to a third embodiment of the present invention.

FIG. 6 shows a perspective view of the main part of a high-frequency circuit device according to a third embodiment of the present invention. In FIG. 6, reference numeral 20 denotes a dielectric plate. A strip conductor 19 is formed on the upper surface of the dielectric plate 20 shown in the figure, and an electrode 22 is formed at each side of the dielectric plate 20 at a specified distance from the strip conductor 19. On the entire back surface of the dielectric plate 20, a ground electrode 21 is formed. With this arrangement, a part indicated by reference numeral 1 acts as a grounded coplanar line. As shown, in a manner well known to skilled persons in the art, magnetic walls are formed within the dielectric plate 20, extending parallel to the coplanar line 1. In this case, the magnetic walls are not exposed to the exterior of the dielectric plate 20. The distance w from the coplanar line 1 to the magnetic wall can be determined as in the case of the first embodiment shown in FIG. 1.

Next, the structure of a high-frequency circuit according to a fourth embodiment of the present invention will be illustrated with reference to FIGS. 7A, 7B and 8.

Figure 7A:
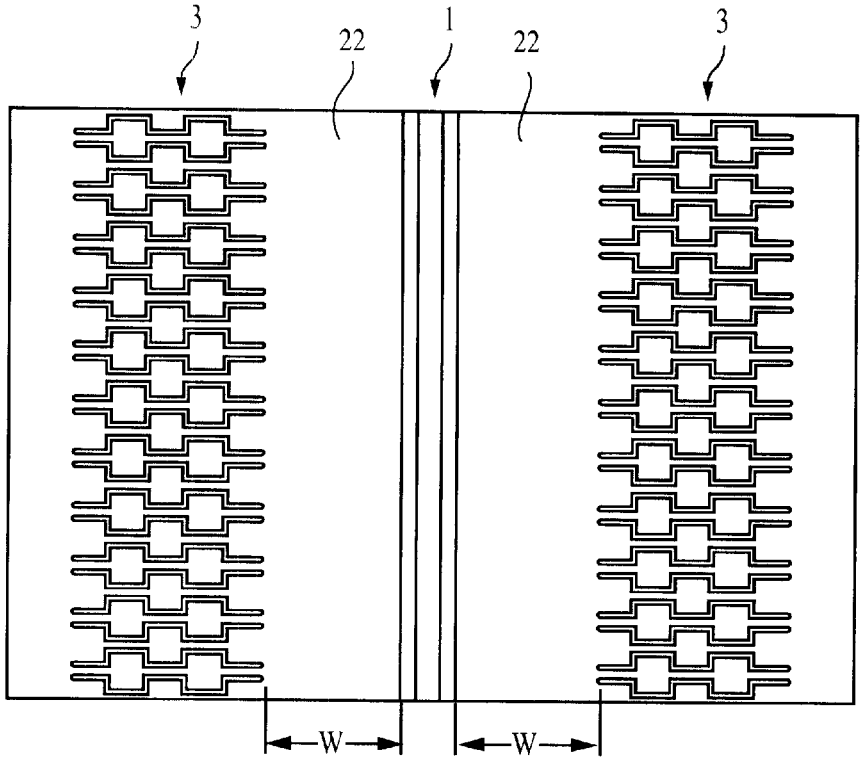
FIGS. 7A and 7B show a plan view illustrating the structure of a high-frequency circuit device according to a fourth embodiment of the present invention, and a partial enlarged view of a spurious mode reflection circuit used in the high-frequency circuit device, respectively.
Figure 7B:
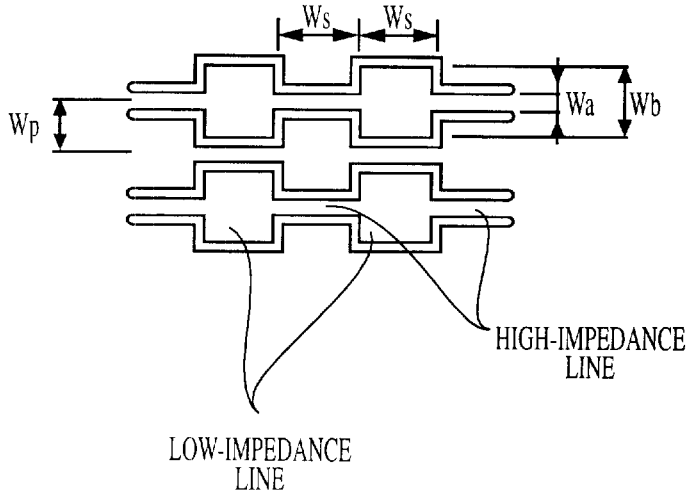

FIGS. 7A and 7B show top views of the main part of the high-frequency circuit device. As shown in FIG. 7A, on the upper surface of a dielectric plate, a coplanar line 1 and a spurious-mode reflection circuit 3 at each side of the coplanar line 1 are formed by patterning electrodes on the upper surface of the dielectric plate. FIG. 7B shows a partial enlarged view of the spurious-mode reflection circuit 3.

When a parallel plate mode is induced, the spurious-mode reflection circuit 3 converts the parallel plate mode into various modes such as a $TE_{010}$ mode, a slot mode, and a micro-strip mode. In this case, particularly, an arrangement is made in such a manner that a pattern in which a quasi-TEM mode of the micro-strip line is totally reflected at a desired frequency. In FIG. 7B, the symbol Wa is 0.3 mm, the symbol Wb is 1.5 mm, the symbol Ws is 1.5 mm, and the thickness of a substrate is 0.3 mm. The part of the line width Wb serves as a low-impedance line, and the part of the line width Wa serves as a high-impedance line. One of the micro-strip lines of the spurious-mode reflection circuit is, equivalently, a circuit produced by repetition of two different kinds of characteristic impedances having fixed electrical lengths.

Figure 8A:
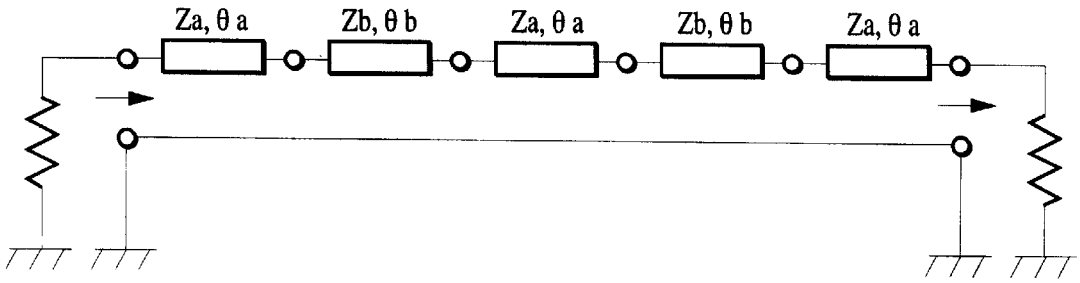
FIGS. 8A and 8B show equivalent circuit diagrams of a spurious mode reflection circuit in the high-frequency circuit device of the fourth embodiment.
Figure 8B:
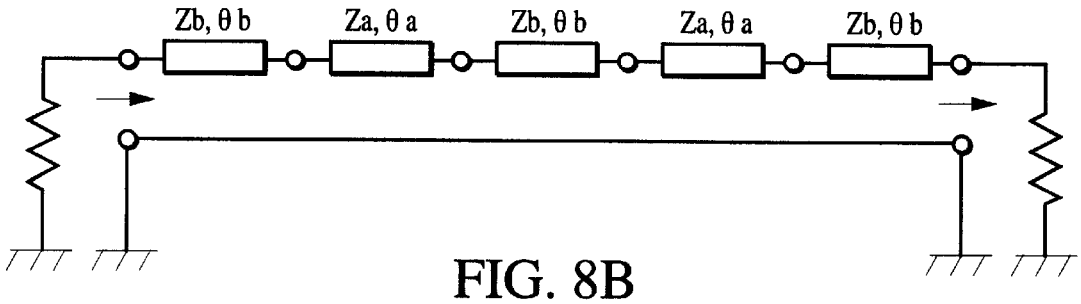

FIGS. 8A and 8B show equivalent circuits illustrating the above circuit. The symbols Za and Zb indicate the characteristic impedances of the micro-strip line. FIG. 8A shows an equivalent circuit of the micro-strip line starting with a high-impedance line and ending with a high-impedance line, and FIG. 8B shows an equivalent circuit thereof starting with a low-impedance line and ending with a low-impedance line. In this figure, Za is larger than Zb. In FIG. 7B, Ws is set to be 1.5 mm, which is ¼ (30 GHz) of the wavelength on the micro-strip line. Thus, electrical lengths $\theta a$ and $\theta b$, respectively, are $\pi/2$ in the equivalent circuits shown in FIGS. 8A and 8B.

With the above-described structures of the micro-strip lines, there are shown characteristics in which a desired-frequency signal of each line is totally reflected at a specified reflection phase.

When the plurality of micro-strip lines are disposed, the distance Wp between adjacent micro-strip lines is set much shorter than a parallel-plate-mode wavelength. In this embodiment, Wp is set to be 1.5 mm. With this arrangement, no leakage of the parallel-plate-mode wave slipping out of the gap between the micro-strip lines occurs.

Figure 9:
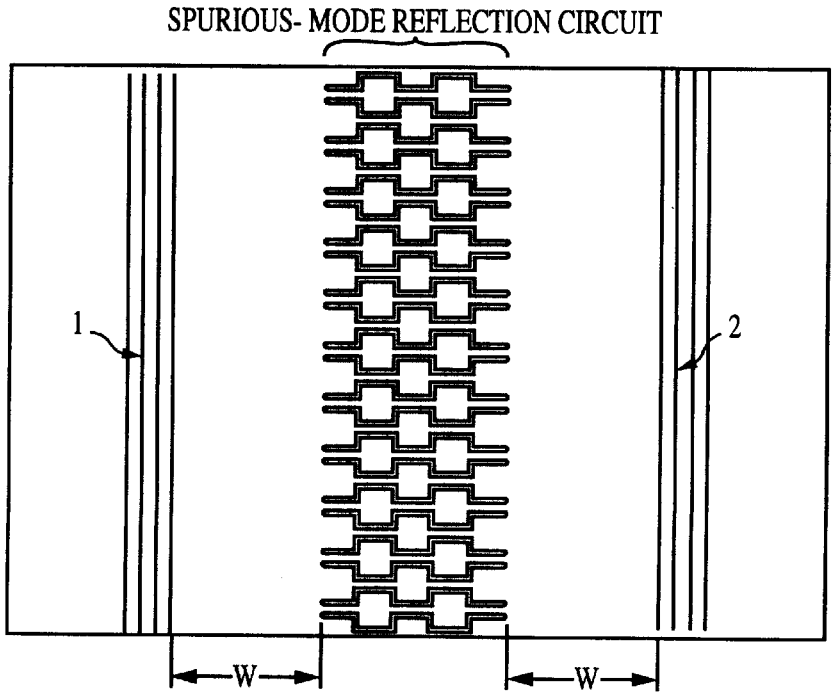
FIG. 9 is a plan view illustrating the structure of a high-frequency circuit device according to a fifth embodiment of the present invention.

FIG. 9 is a top view of the main part of a high-frequency circuit according to a fifth embodiment. Unlike the device shown in FIG. 7 having the spurious-mode reflection circuit at each side of the grounded coplanar line, in the device shown in FIG. 9, a spurious-mode reflection circuit 3 is disposed between two grounded coplanar lines 1 and 2 to prevent interference between the two grounded coplanar lines 1 and 2. In other words, the distance w between each of the two grounded coplanar lines 1 and 2 and the spurious-mode reflection circuit 3 is determined by the aforementioned conditions.

Figure 10:
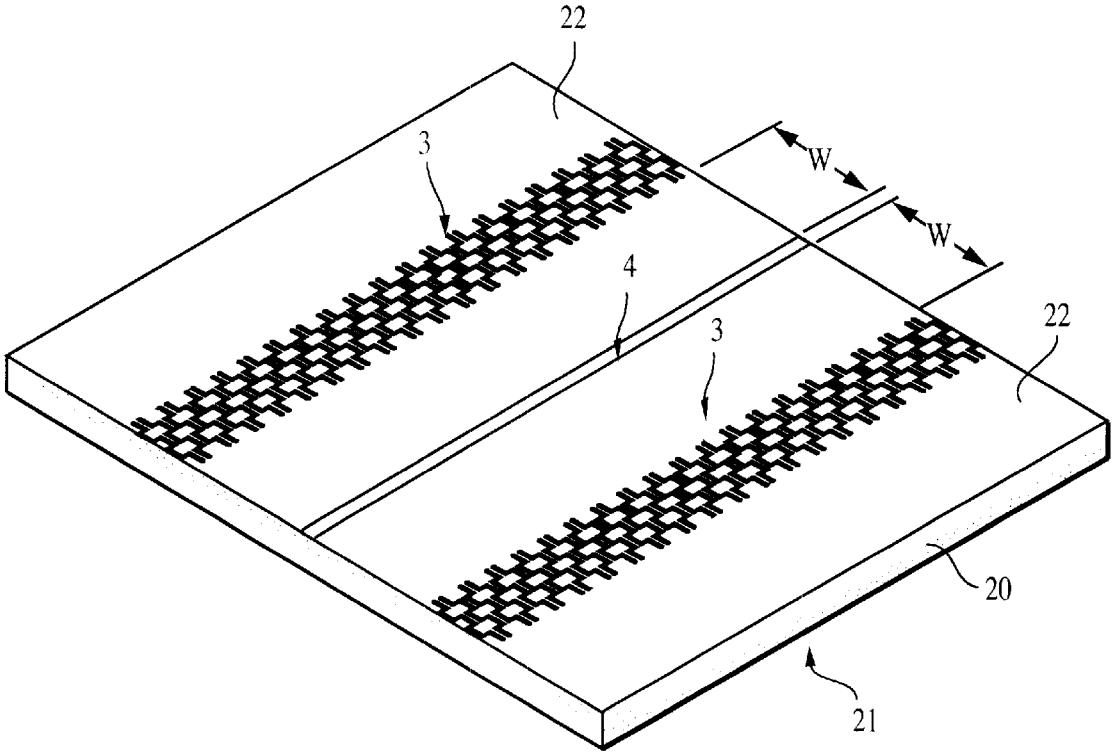
FIG. 10 is a perspective view illustrating the structure of a high-frequency circuit device according to a sixth embodiment of the present invention.

FIG. 10 shows a perspective view of the main part of a high-frequency circuit device according to a sixth embodiment of the present invention. In this embodiment, a grounded slot line 4 is formed, and at each side thereof, and a pair of spurious-mode reflection circuits 3 are disposed at a distance w determined by the equation (4).

Figure 11A:
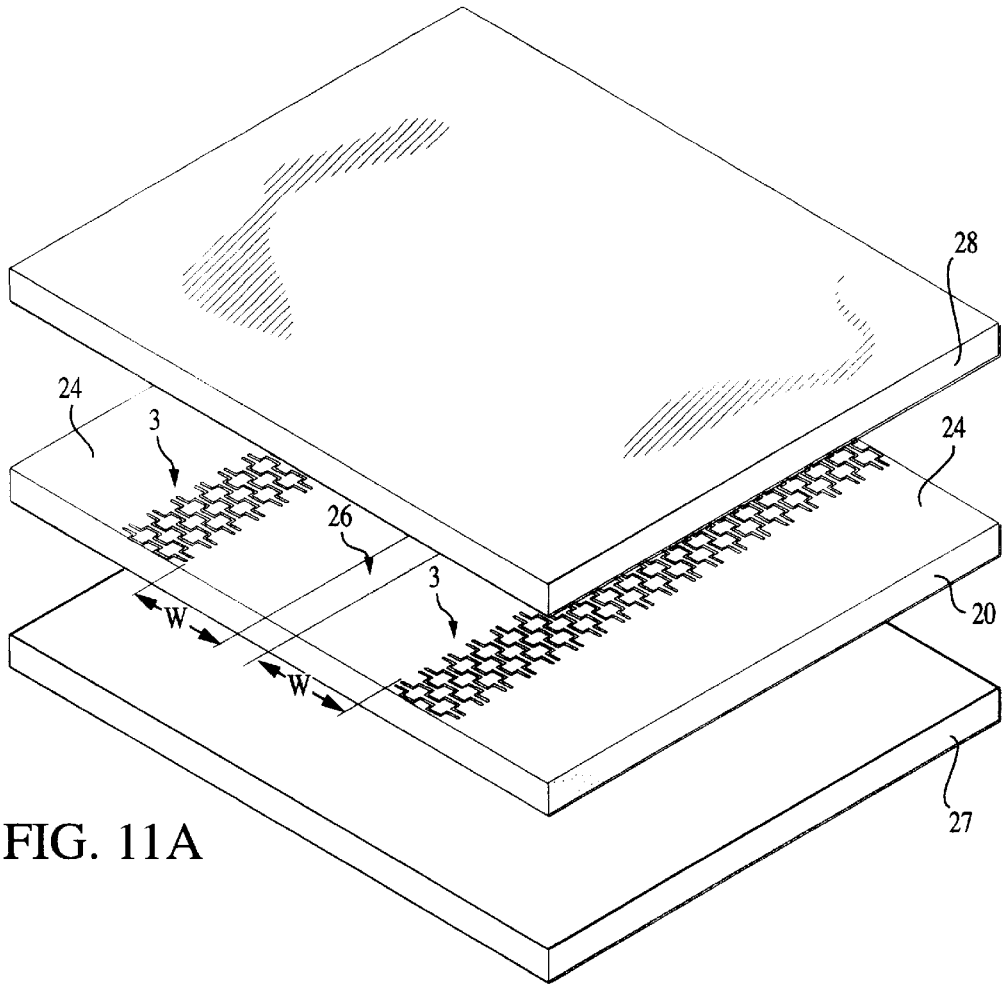
FIGS. 11A and 11B show a perspective view illustrating the structure of a high-frequency circuit device according to a seventh embodiment of the present invention, and the lower-surface view of a dielectric plate used in the device, respectively.
Figure 11B:
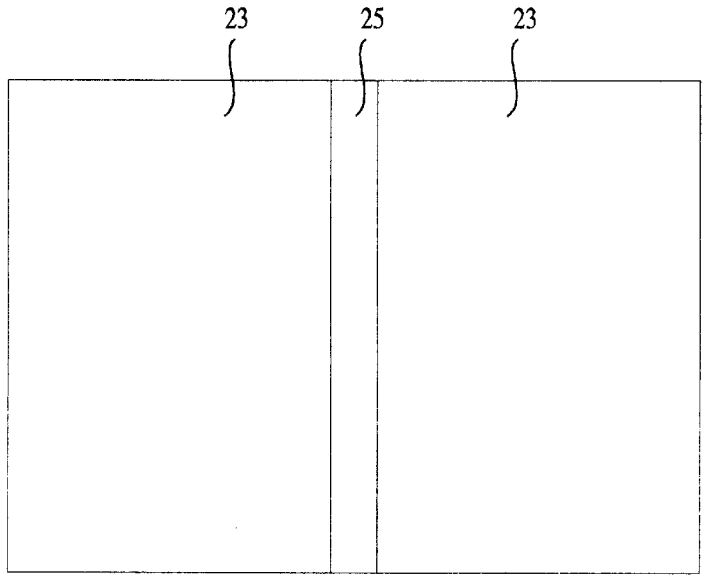

FIGS. 11A and 11B show the structures of the main part of a high-frequency circuit device according to a seventh embodiment of the present invention. FIG. 11A is a perspective view of the high-frequency circuit device, and FIG. 11B is the lower surface view of a dielectric plate 20 used in the high-frequency circuit device. On the upper and lower surfaces of the dielectric plate 20 are formed electrodes 23 and 24 having slots mutually opposing through the dielectric plate 20. Above and under the dielectric plate 20 are disposed conductor plates 27 and 28, respectively, parallel to the plate 20 at specified distances therefrom. This structure permits a planar dielectric line (PDTL) to be formed. A background example of a planar dielectric line is disclosed in Japanese Unexamined Patent Application Publication No. 8-265007 (Japanese Patent Application No. 7-69867).

On the dielectric plate 20, by patterning the electrodes 24 formed on the upper surface thereof, spurious-mode reflection circuits 3 similar to those shown in FIG. 10 are disposed parallel to a slot 26 at specified distances from the slot 26.

With this structure, the generated modes include a parallel plate mode propagating between the electrodes 23 and 24 formed on the upper and lower surfaces of the dielectric plate 20, a parallel plate mode propagating in a space between the electrode 24 and the conductor plate 28, and a parallel plate mode propagating in a space between the electrode 23 and the conductor plate 27. All of these modes are totally reflected by the spurious-mode reflection circuits 3 and thereby returned to the part where the planar dielectric line is formed so that all of the modes are cancelled and suppressed.

Figure 12A:
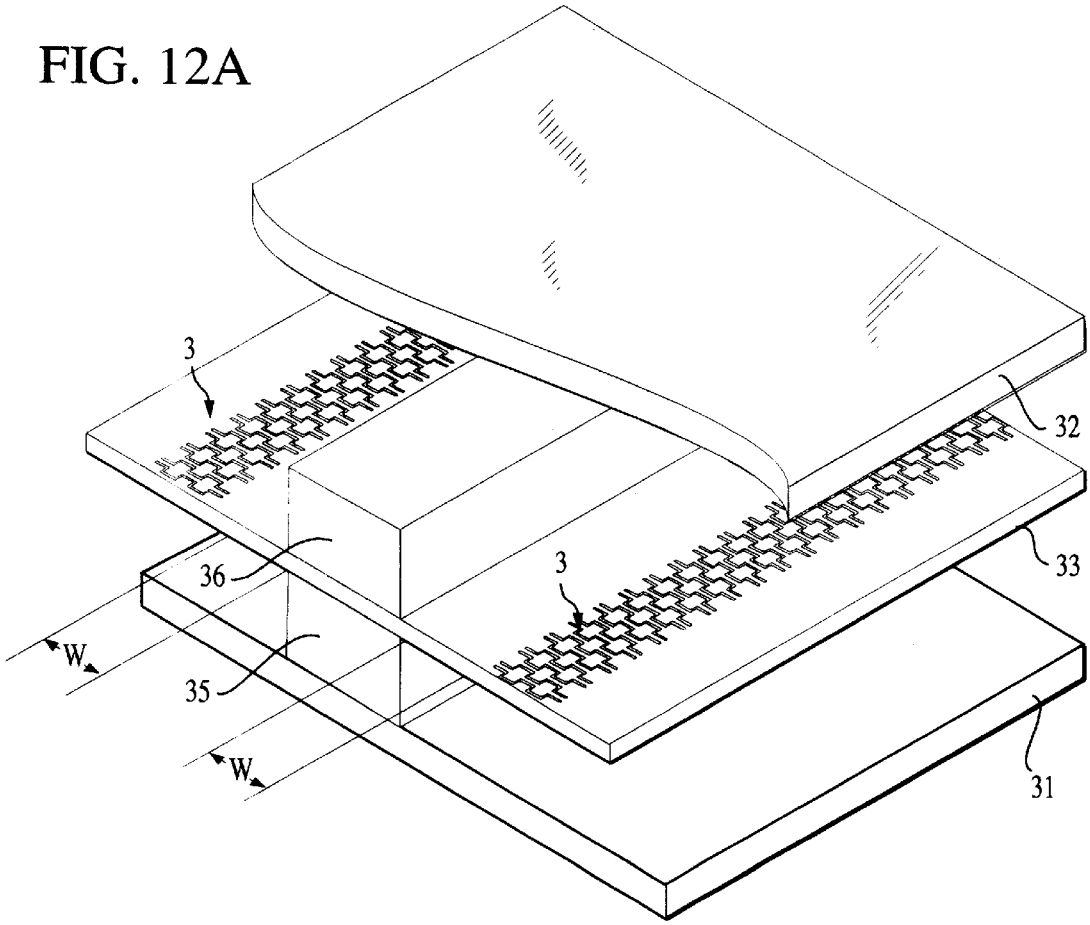
FIGS. 12A and 12B show a perspective view and a sectional view illustrating the structure of a high-frequency circuit device according to an eighth embodiment of the present invention.
Figure 12B:
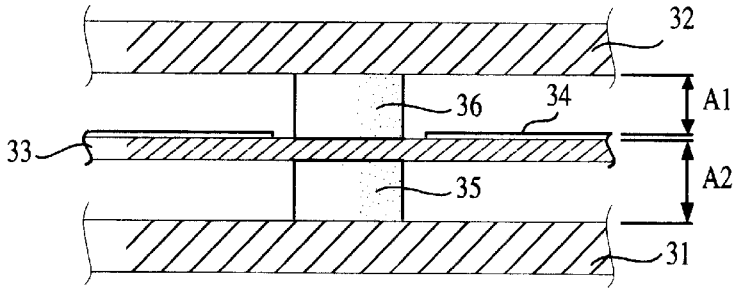

FIGS. 12A and 12B show the structure of a high-frequency circuit device according to an eighth embodiment of the present invention. FIG. 12A is a partial cut-away perspective view of the main part of the high-frequency circuit device, and FIG. 12B is a sectional view thereof. In these figures, reference numerals 35 and 36 denote dielectric strips, and reference numeral 33 denotes a dielectric plate having electrodes 34 formed on the upper surface thereof The dielectric strips 35 and 36, and the dielectric plate 33 are disposed between conductor plates 31 and 32. With this arrangement, a nonradiative dielectric waveguide (NRD waveguide) is formed in which propagation of an electromagnetic wave is performed by trapping electromagnetic energy in the dielectric strips 35 and 36.

Usually, in a dielectric line, since disturbance of an electromagnetic field occurs at non-continued parts of the line, such as junctions and bends of the dielectric strip, a spurious mode wave such as a parallel-plate mode wave propagates between upper and lower conductor plates.

On the dielectric plate 33, by patterning each of the electrodes 34 formed on the upper surface thereof, at each side of the dielectric strips 35 and 36, a spurious-mode reflection circuit 3 is disposed at a distance w determined by the equation (4). With this arrangement, as shown in FIG. 12B, a parallel-mode electromagnetic wave propagating in the space (A1) between the electrodes 34 and the conductor plate 32 thereabove and in the space (A2) between the electrodes 34 and the conductor plate 31 thereunder, respectively, is converted into a quasi-TEM mode by the micro-strip lines of the spurious-mode reflection circuits 3 and is thereby totally reflected.

Figure 13:
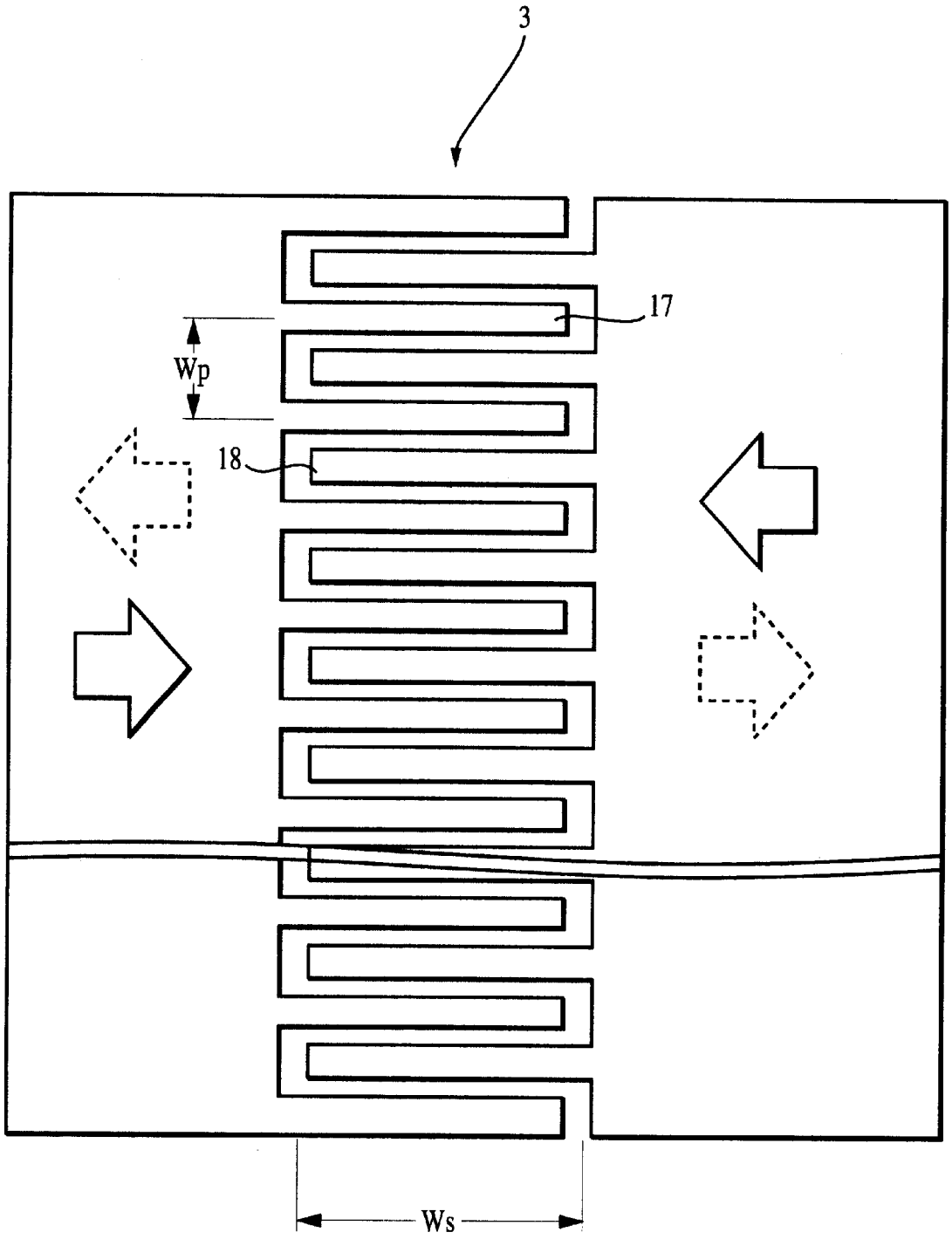
FIG. 13, is a plan view of a spurious-mode reflection circuit of a high-frequency circuit device according to a ninth embodiment of the present invention.

Next, FIG. 13 shows a spurious-mode reflection circuit used in a high-frequency circuit device according to a ninth embodiment of the present invention. In this circuit, a plurality of micro-strip lines having open-circuited ends are disposed parallel to each other. In this figure, a micro-strip line 17 extending from the left to the right and another micro-strip line 18 extending from the right to the left are disposed in such a manner that they are opposed to each other. The spurious-mode reflection circuit of FIG. 13 can be used, for example, in an arrangement similar to that shown in FIG. 9.

The distance Wp between the adjacent micro-strip lines 17 and 18 is set to be much shorter than the parallel-plate mode wavelength. Since the distance Wp is set like this, no parallel-plate-mode wave leaks by slipping out of the space between the micro-strip lines. In addition, the line length Ws of each of the micro-strip lines is set to be shorter than ½ of the wavelength at a desired frequency, which is a frequency of a slot mode induced between the adjacent micro-strip lines. With this arrangement, since a cut-off frequency of the slot mode becomes sufficiently high, a spurious mode such as the parallel plate mode is not converted into a slot mode. As a result, there is no possibility in which the spurious mode is again converted into a parallel plate mode via the slot mode, and the parallel plate mode is propagated. The spurious-mode electromagnetic wave such as a parallel mode wave, which propagates between the electrodes formed on the upper and lower surfaces of the dielectric plate, is converted into a quasi-TEM mode of the micro strip at the micro-strip line to be propagated. However, since each end of the micro-strip lines is open-circuited, the spurious mode wave is totally reflected at the open-circuited ends.

Next, a high-frequency circuit device having a resonator will be illustrated with reference to FIGS. 14 to 16.

Figure 14:
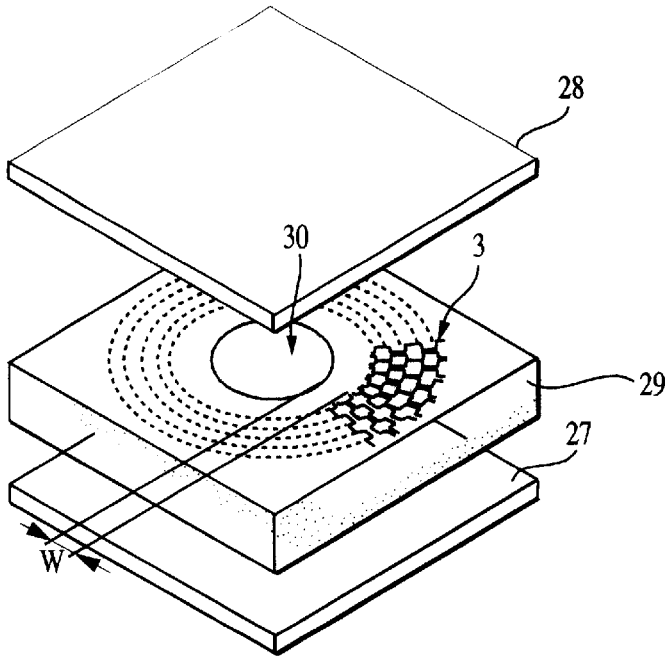
FIG. 14 is a perspective view illustrating the structure of a high-frequency circuit device according to a tenth embodiment of the present invention.

In FIG. 14, electrodes are formed on the upper and lower surfaces of a dielectric plate 29. Within these electrodes are formed circular electrodeless portions mutually opposing each other through the dielectric plate 29. Reference numeral 30 denotes the electrodeless portion disposed at the electrode formed on the upper surface of the dielectric plate 29. This arrangement permits a dielectric resonator whose electrodeless portion is used as a magnetic wall to be formed. In this embodiment, the dielectric resonator acts as a $TE_{010}$-mode resonator. At the upper-surface electrode of the dielectric plate 29, a spurious-mode reflection circuit 3 is formed by patterning. The spurious-mode reflection circuit 3 is comprised of micro-strip lines, in which high-impedance lines and low-impedance lines are alternately connected in series in a radial form around a resonator at a center. In other words, whereas the pattern of the spurious-mode reflection circuit shown in FIGS. 7A and 7B is used as Cartesian coordinates, the pattern of the spurious-mode reflection circuit 3 shown in FIG. 14 is equivalent to a pattern obtained by converting the Cartesian coordinates into polar coordinates. However, the dimensions of the large-width part and small-width part of each of the micro-strip lines may be made the same on one of the micro-strip lines. This figure shows a part of the micro-strip line, and the remaining part thereof is omitted.

A part of the electromagnetic-field energy trapped in the dielectric resonator extends as a parallel plate mode in a radial direction around the dielectric resonator as a center between the upper and lower electrodes of the dielectric plate 29. The parallel plate mode is converted into a quasi-TEM mode by the spurious-mode reflection circuit 3 to be totally reflected. The distance between the spurious-mode reflection circuit 3 and the dielectric resonator is set as the symbol w determined by the equation (4). However, since electromagnetic fields occurring in the circumferential direction of the $TE_{010}$-mode resonator all have the same phase, the value of $\beta$ becomes zero. As a result, since the equation is more simplified, the relationship expressed by an equation: $w=\{m\pi-\arg(\Gamma)\}/2k$ is obtained. With this result, the spurious mode can be effectively suppressed. In addition, there is no possibility of leakage of the spurious mode from the reflection circuit 3 to the outside.

Figure 15:
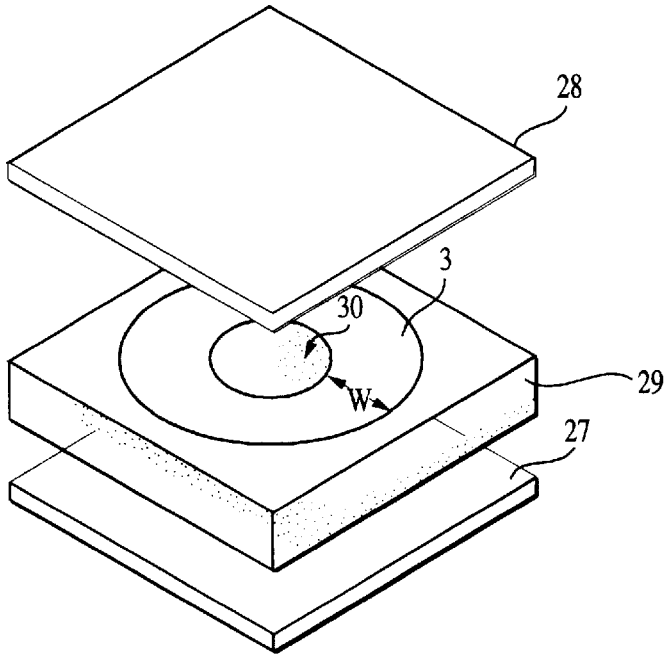
FIG. 15 is a perspective view illustrating the structure of a high-frequency circuit device according to an eleventh embodiment of the present invention.

Similar to this, in an example shown in FIG. 15, in electrodes formed on the upper and lower surfaces of a dielectric plate 29 are formed circular electrodeless portions mutually opposing each other through the dielectric plate 29. Reference numeral 30 denotes the electrodeless portion disposed at the electrode formed on the upper surface of the dielectric plate 29. This arrangement permits a $TE_{010}$-mode resonator having the electrodeless portion used as a magnetic wall to be formed. On at least one of the upper and lower surfaces of the dielectric plate 29, a ring-shaped electrode having a specified width w measured from the electrodeless portion 30 is formed as a spurious-mode reflection circuit 3. The external-circumferential boundary part of the spurious-mode reflection circuit 3 acts as a magnetic wall. The distance between the magnetic wall and the resonator is set as w, as determined by equation (4). With this arrangement, since the parallel plate mode leaking from the resonator is totally reflected by the spurious-mode reflection circuit 3, the spurious-mode leakage wave and the reflected wave cancel each other. As a result, this leads to suppression of the spurious mode.

Figure 16:
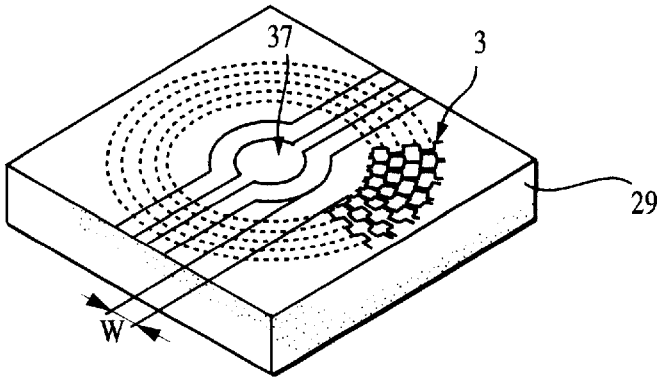
FIG. 16 is a perspective view illustrating the structure of a high-frequency circuit device according to a twelfth embodiment of the present invention.

In an example shown in FIG. 16, an electrode is formed on the entire lower surface of a dielectric plate 29, and a circular resonator electrode 37 is formed on the upper surface thereof. With this arrangement, a TM mode dielectric resonator is provided in which the circular resonator electrode 37 is used as an electric wall. In this case, a spurious-mode reflection circuit 3 is formed by an electrode pattern on the upper surface of the dielectric plate 29.

In such a TM-mode resonator, it is difficult to express the distance w between the spurious-mode reflection circuit 3 and the electrode inner periphery with a specified resonance mode by an equation. However, the distance w can be determined without undue experimentation, in such a manner that a spurious mode can be effectively suppressed.

Next, the structural example of a voltage-controlled oscillator will be illustrated with reference to FIG. 17.

Figure 17:
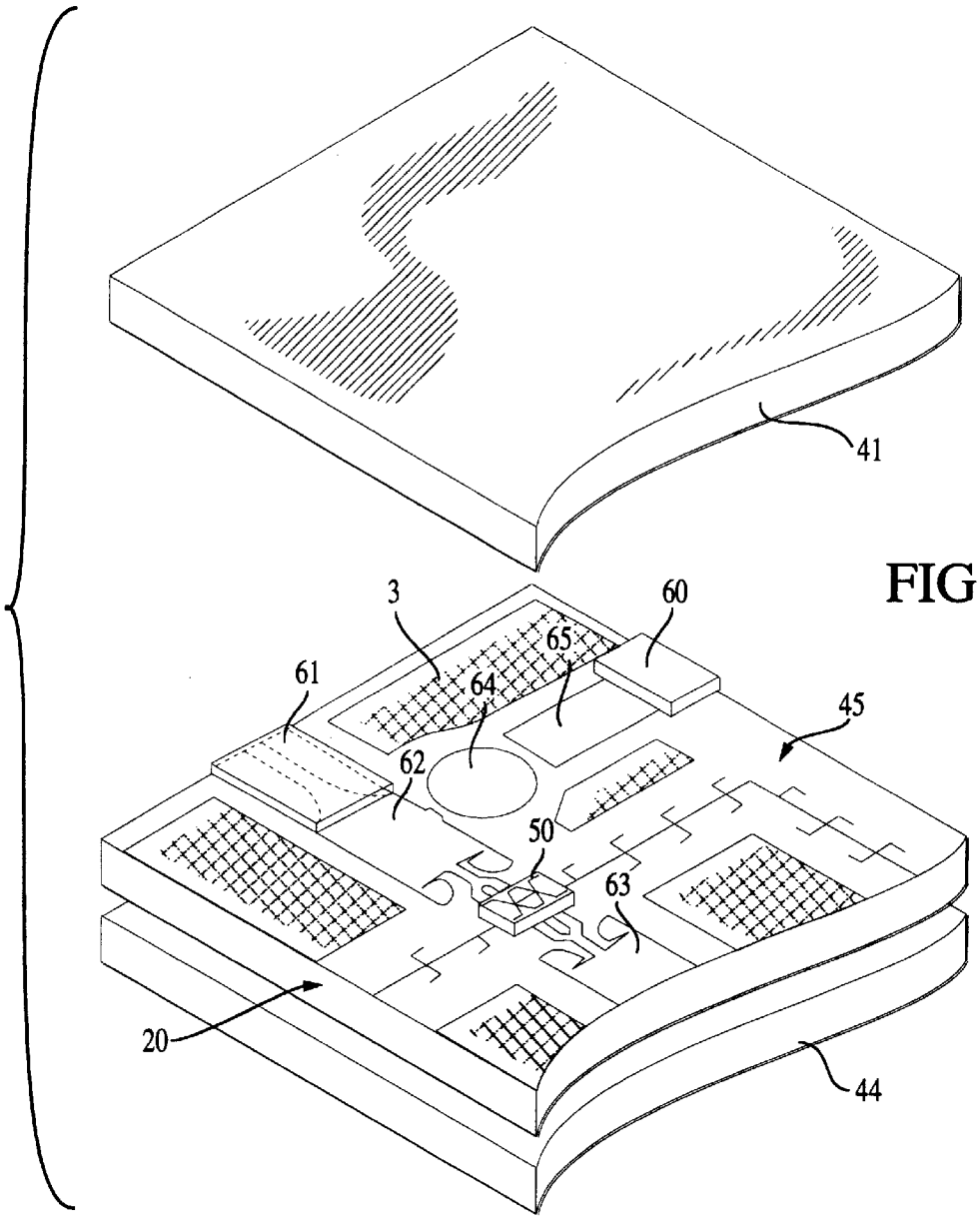
FIG. 17 is a perspective view illustrating the structure of a voltage-controlled oscillator according to a thirteenth embodiment of the present invention.

FIG. 17 is an exploded perspective view showing a structure of the voltage-controlled oscillator. Reference numerals 41 and 44 denote an upper conductor plate and a lower conductor plate, between which a dielectric plate 20 is disposed. In FIG. 17, the upper conductor plate 41 is shown in such a manner that the plate 41 is disposed far apart from the dielectric plate 20. On the upper and lower surfaces of the dielectric plate 20, various kinds of conductor patterns are formed. On the upper surface of the dielectric plate 20, a slot-line input-type millimeter wave GaAs FET 50 is mounted. Reference numerals 62 and 63 denote slots on the upper surface of the dielectric plate 20. The slots 62 and 63 are formed by disposing each pair of electrodes at fixed distances on the upper surface thereof. These slots 62 and 63, in addition to slots formed on the lower surface of the dielectric plate 20, are provided to form a planar dielectric line. Reference numeral 45 is a coplanar line, which supplies a gate bias voltage and a drain bias voltage to the FET 50.

Reference numeral 61 denotes a thin-film resistor, which is disposed on the top part of a tapered-down end of the slot 62 formed on the upper surface of the dielectric plate 20. Reference numeral 65 is another slot disposed on the upper surface of the dielectric plate 20. In addition, on the back surface, spaced away by the thickness of the dielectric plate 20, is also disposed another slot to form another planar dielectric line. Reference numeral 60 denotes a variable capacitance element, having a capacitance which varies with an applied voltage, mounted on the upper surface of the dielectric plate 20 in such a manner that the element 60 extends over the slot 65. In addition, in the figure, reference numeral 64 denotes a non-conductor portion which forms a dielectric-resonator disposed on the upper surface of the dielectric plate 20. A $TE_{010}$-mode dielectric resonator is formed by the non-conductor portion 64 and another dielectric-resonator non-conductor portion opposing thereto through the thickness of the plate 20, which is disposed on the back surface thereof.

The cross-hatched parts shown in FIG. 17 are spurious-mode reflection circuit 3 formed by electrodes. Another spurious-mode reflection circuit 3 is symmetrically formed on the lower surface of the dielectric plate 20. These spurious-mode reflection circuits 3 are disposed spaced apart from the planar dielectric line, the coplanar line, and the dielectric resonator, and the like, by a distance required to cancel the spurious-mode leakage wave and the reflected wave. The spurious mode can be effectively suppressed by forming the spurious-mode reflection circuits 3 as shown here. For example, interference caused by leakage waves generated between the planar dielectric line formed of the slot 63, the planar dielectric line formed of the slot 65, and the dielectric resonator formed at the slit 64 can be prevented.

Figure 18:
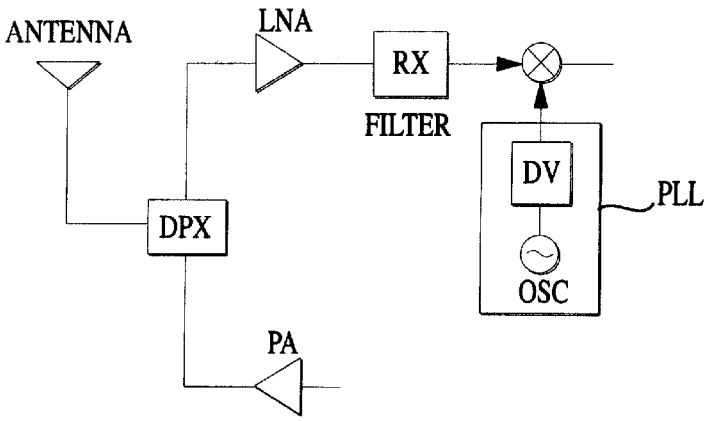
FIG. 18 is a block diagram illustrating the structure of a communication apparatus according to a fourteenth embodiment of the present invention.
Figure 19:
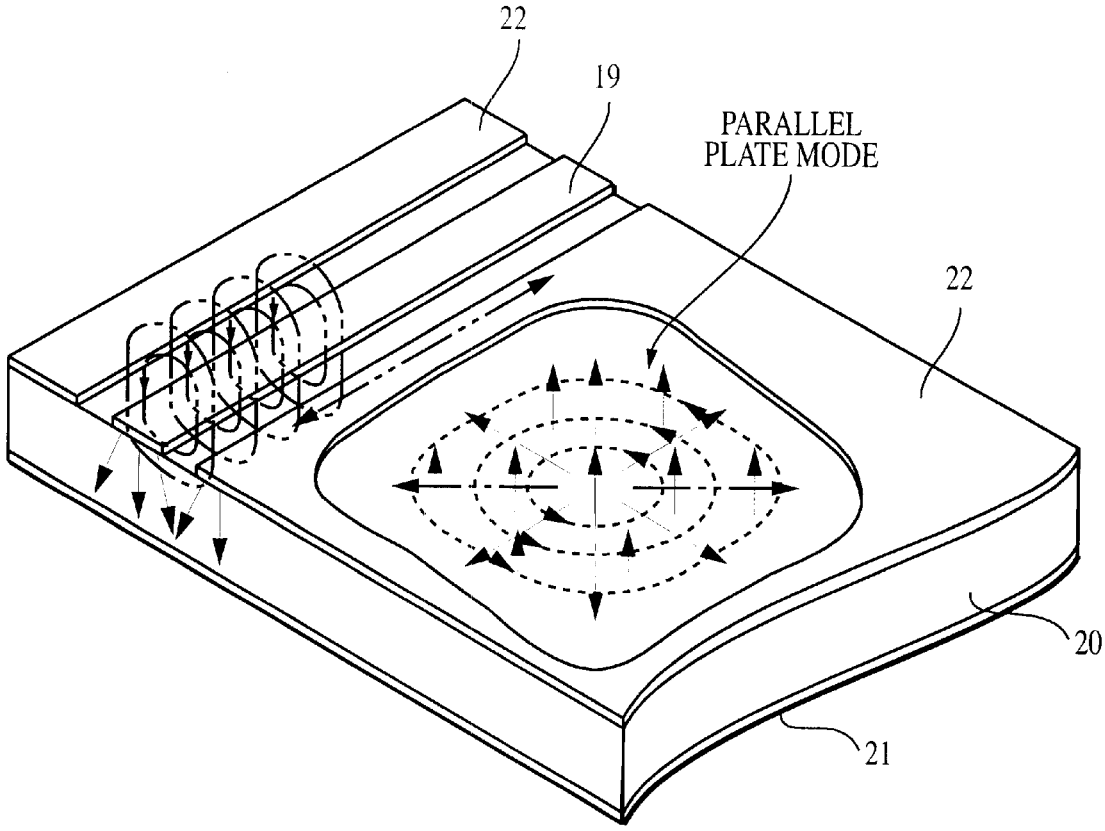
FIG. 19 PRIOR ART
FIG. 19 is a partial cut-away perspective view showing a parallel plate mode of the prior art.

FIG. 18 is a block diagram illustrating the structure of a communication apparatus using the above voltage-controlled oscillator. In this figure, the symbol DPX denotes an antenna duplexer, to which a signal transmitted from a power amplifier PA is input. The signal received from the DPX is sent to a mixer through a low-noise amplifier LNA and a reception filter RX. Meanwhile, a local oscillator formed as a PLL is comprised of an oscillator OSC and a frequency divider DV dividing a signal oscillated from the OSC. A local signal from the local oscillator PLL is supplied to the mixer. In this case, the aforementioned voltage-controlled oscillator is used as the oscillator OSC.

As described above, according to one aspect of the present invention, spurious mode waves propagating between two parallel planar conductors can be efficiently suppressed. In addition, loss in conversion from the main propagating mode into a spurious mode, and unnecessary couplings between lines, circuits, and unnecessary couplings between the lines and circuits via the spurious mode can be prevented.

In addition, since only patterning of electrodes is used to form a spurious-mode reflection circuit, production can be facilitated.

In addition, since the edges of a dielectric plate and the edges of electrodes formed on the dielectric plate can be used as spurious-mode reflection circuits, with no need of finely-made electrode patterns, the spurious-mode reflection circuits can be easily formed.

In addition, interference caused by leakage waves between transmission lines, and interference caused by leakage waves between the transmission lines and resonators can be prevented.

In addition, interference caused by leakage waves generated between the resonators and the remaining transmission lines, and interference between the resonators can be prevented.

Furthermore, according to another aspect of the present invention, in a communication-signal propagating unit and a signal processing unit such as a filter allowing a communicating signal to be passed and/or blocked in a specified frequency band, even if the distance between the lines and the resonators is decreased, interference between the lines and interference between the lines and the resonators can be reliably prevented. As a result, an overall compact communication apparatus can be formed.

While the invention has been described in connection with embodiments thereof, modifications and variations are possible in light of the above teachings. It is therefore to be understood that within the scope of the appended claims, the invention may be practiced otherwise than as specifically described.

What is claimed is:

1. A high-frequency circuit device comprising:

at least two parallel planar conductors;

an electromagnetic-wave excitation circuit exciting an electromagnetic wave between two planar conductors the electromagnetic wave having a main propagating mode wave; and a spurious-mode reflection circuit reflecting a spurious mode wave which is generated from a first leakage wave of the main propagating mode wave, the spurious mode wave propagating between the two planar conductors;

wherein the spurious mode reflection circuit is disposed spaced apart from the electromagnetic-wave excitation circuit by a distance at which a second leakage wave of the main propagating mode wave cancels the spurious mode wave reflected by the spurious-mode reflection circuit so that the reflected spurious mode wave does not interfere with the main propagating mode wave.

2. A high-frequency circuit device according to claim 1, wherein the distance, represented by the symbol w, is obtained by the following equation:

$$w=\{m\pi-\arg(\Gamma)\}/[2k\sqrt{\{1-(\beta/k)^2\}}];$$

wherein the symbol m represents an odd number of 1 or greater, the symbol arg(Γ) represents a reflection phase in the spurious mode reflection circuit, the symbol k represents a vector k corresponding to a direction in which the spurious mode wave propagates, and the symbol β represents a phase constant of the main propagating mode wave of the electromagnetic-wave excitation circuit.

3. A high-frequency circuit device according to one of claims 1 and 2, wherein the spurious-mode reflection circuit is comprised of a plurality of micro-strip lines disposed at distances from each other, the distances being shorter than the length of the electromagnetic wave.

4. A high-frequency circuit device according to claim 3, wherein the electromagnetic-wave excitation circuit is a transmission line.

5. A high-frequency circuit device according to claim 3, wherein the electromagnetic-wave excitation circuit is a resonator.

6. A high-frequency circuit device according to one of claims 1 and 2, wherein the electromagnetic-wave excitation circuit is a transmission line.

7. A high-frequency circuit device according to one of claims 1 and 2, wherein the electromagnetic-wave excitation circuit is a resonator.

8. A high-frequency circuit device according to one of claims 1 and 2, wherein the spurious-mode reflection circuit is a magnetic wall generated on a dielectric plate having the two planar conductors formed thereon.

9. A high-frequency circuit device according to claim 8, wherein the electromagnetic-wave excitation circuit is a transmission line.

10. A high-frequency circuit device according to claim 8, wherein the electromagnetic-wave excitation circuit is a resonator.

11. A high-frequency circuit device according to one of claims 1 and 2, wherein the spurious-mode reflection circuit is an electric wall formed on a dielectric plate having the two planar conductors formed thereon.

12. A high-frequency circuit device according to claim 11, wherein the electromagnetic-wave excitation circuit is a transmission line.

13. A high-frequency circuit device according to claim 11, wherein the electromagnetic-wave excitation circuit is a resonator.

14. A communication apparatus comprising the high-frequency circuit device according to one of claims 1 and 2, the high-frequency circuit device being connected to at least one of a communication-signal propagating unit and a communication-signal processing unit.

* * * * *